US008584863B2

(12) United States Patent
Bender et al.

(10) Patent No.: US 8,584,863 B2
(45) Date of Patent: Nov. 19, 2013

(54) SEPARATING DEVICE FOR SEPARATING MAGNETIZABLE PARTICLES AND NON-MAGNETIZABLE PARTICLES TRANSPORTED IN A SUSPENSION FLOWING THROUGH A SEPARATING CHANNEL

(75) Inventors: Kathrin Bender, Grünstadt (DE); Jürgen Oswald, Frankenthal (DE); Wolfgang Schmidt, Erlangen (DE); Bernd Trautmann, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 256 days.

(21) Appl. No.: 13/063,844

(22) PCT Filed: Sep. 1, 2009

(86) PCT No.: PCT/EP2009/061241

§ 371 (c)(1),
(2), (4) Date: Mar. 14, 2011

(87) PCT Pub. No.: WO2010/031679

PCT Pub. Date: Mar. 25, 2010

(65) Prior Publication Data

US 2011/0163014 A1 Jul. 7, 2011

(30) Foreign Application Priority Data

Sep. 18, 2008 (DE) ..... 10 2008 047 855

(51) Int. Cl.
*B03C 1/00* (2006.01)

(52) U.S. Cl.
USPC ..... 209/39; 209/214; 209/232

(58) Field of Classification Search
USPC ..... 209/39, 214, 223.1, 232; 210/222, 223
See application file for complete search history.

(56) References Cited

U.S. PATENT DOCUMENTS 3,394,807 A * 7/1968 Rudiger et al. ..... 209/219
3,402,820 A * 9/1968 Lohmann ..... 210/222

(Continued)

FOREIGN PATENT DOCUMENTS

CN 1275445 A 12/2000 ..... B03C 1/025
CN 101208153 A 6/2008 ..... B03C 1/035

(Continued)

OTHER PUBLICATIONS

Chinese Office Action, Application No. 200980136683.0, 9 pages, Jan. 28, 2013.

(Continued)

*Primary Examiner* — Joseph C Rodriguez
(74) *Attorney, Agent, or Firm* — King & Spalding L.L.P.

(57) ABSTRACT

A separating device (1, 10, 14, 16, 17) for separating particles able to be magnetized and particles not able to be magnetized transported in a suspension flowing through a separating channel (3), has at least one permanent magnet (4, 4*a*, 4*b*, 4*c*, 4*d*) arranged on at least one side of the separating channel (3) for producing a magnetic field gradient which deflects particles able to be magnetized to said side, wherein a yoke (5) is provided for closing the magnetic circuit from the permanent magnet (4, 4*a*, 4*b*, 4*c*, 4*d*) to the side of the separating channel (3) opposite the permanent magnet (4, 4*a*, 4*b*, 4*c*, 4*d*) and/or between two permanent magnets (4, 4*a*, 4*b*, 4*c*, 4*d*).

18 Claims, 3 Drawing Sheets

(56) References Cited

U.S. PATENT DOCUMENTS

| | | | | |
|---|---|---|---|---|
| 4,605,498 | A * | 8/1986 | Kulish | 210/222 |
| 5,055,189 | A * | 10/1991 | Ito | 210/222 |
| 5,380,430 | A | 1/1995 | Overton et al. | 210/222 |
| 5,466,574 | A * | 11/1995 | Liberti et al. | 435/5 |
| 5,541,072 | A | 7/1996 | Wang et al. | 435/7.21 |
| 6,241,894 | B1 | 6/2001 | Briggs et al. | 210/695 |
| 6,277,275 | B1 | 8/2001 | Yoshifusa et al. | 210/222 |
| 6,851,557 | B1 * | 2/2005 | Svoboda | 209/39 |
| 7,776,221 | B2 * | 8/2010 | Brassard | 210/695 |
| 2005/0208464 | A1 | 9/2005 | Rida et al. | 435/4 |
| 2005/0266394 | A1 | 12/2005 | Hatton et al. | 435/4 |
| 2011/0163014 | A1 | 7/2011 | Bender et al. | 209/214 |
| 2011/0174710 | A1 * | 7/2011 | Hartmann et al. | 210/222 |

FOREIGN PATENT DOCUMENTS

| | | | | |
|---|---|---|---|---|
| EP | 1331035 | A1 | 7/2003 | B03C 1/035 |
| EP | 1661625 | A1 | 5/2006 | B03C 1/035 |
| JP | 8252723 | A | 10/1996 | B03C 1/28 |
| JP | 2006247487 | A | 9/2006 | B03C 1/28 |
| WO | 2004/078316 | A1 | 9/2004 | B01D 35/06 |
| WO | 2004/106245 | A1 | 12/2004 | C02F 1/48 |
| WO | 2006/136237 | A1 | 12/2006 | B03C 1/035 |
| WO | 2010/031679 | A1 | 3/2010 | B03C 1/033 |

OTHER PUBLICATIONS

International PCT Search Report and Written Opinion, PCT/EP2009/061241, 13 pages, Dec. 1, 2009.

* cited by examiner

SEPARATING DEVICE FOR SEPARATING MAGNETIZABLE PARTICLES AND NON-MAGNETIZABLE PARTICLES TRANSPORTED IN A SUSPENSION FLOWING THROUGH A SEPARATING CHANNEL

CROSS-REFERENCE TO RELATED APPLICATIONS

This application is a U.S. National Stage Application of International Application No. PCT/EP2009/061241 filed Sep. 1, 2009, which designates the United States of America, and claims priority to DE Application No. 10 2008 047 855.5 filed Sep. 18, 2008. The contents of which are hereby incorporated by reference in their entirety.

TECHNICAL FIELD

The invention relates to a separating device for separating magnetizable particles and non-magnetizable particles transported in a suspension flowing through a separating channel, having at least one permanent magnet arranged on at least one side of the separating channel for generating a magnetic field gradient which deflects magnetizable particles to said side.

BACKGROUND

In particular in the course of ore extraction or in the area of scrap separation, it is often intended to separate particles of different magnetic properties from one another, in particular magnetizable particles from non-magnetizable particles. It has been proposed for this purpose to arrange one or more permanent magnets near a separating channel, which is defined for example by a tube, in order to generate a magnetic field gradient inside the tube. Then a suspension which contains the magnetizable particles and non-magnetizable particles is passed through the separating channel. On account of the prevailing magnetic field gradients, the magnetizable particles are subjected to the action of forces that are also in a scalar relationship with the field strength and deflect them particularly toward the side wall of the separating channel that is adjacent to the permanent magnet.

Continuous processes in which the laterally separated magnetizable particles are to be separated from the non-magnetic particles by a separating device, for example a screen, have been proposed, but the force distribution in the separating channel is then usually so inhomogeneous that deposits form on the walls. It is therefore often customary to provide magnetic field gradients and magnetic fields of a strength that leads to the accumulation of the magnetizable fraction on the walls of the separating channel, so that it can be removed in a subsequent flushing step.

However, the magnetic field gradients/field strengths generated by such an arrangement are disadvantageously too small in extensive areas of the separating channel to ensure an effective separation.

SUMMARY

According to various embodiments, a separating device can be provided in which an improved separation can be achieved on the basis of higher field strengths or magnetic field gradients.

According to an embodiment, a separating device for separating magnetizable particles and non-magnetizable particles transported in a suspension flowing through a separating channel, has at least one permanent magnet arranged on at least one side of the separating channel for generating a magnetic field gradient which deflects magnetizable particles to said side, wherein a yoke is provided for closing the magnetic circuit from the permanent magnet to the side of the separating channel that is opposite from the permanent magnet and/or between two permanent magnets.

According to a further embodiment, the surface of the yoke that is opposite from the permanent magnet and adjacent to the separating channel can be larger than the surface of the permanent magnet that is facing the separating channel, in particular the yoke taken on one side around the separating channel is formed on the side opposite from the permanent magnet such that it extends beyond the separating channel. According to a further embodiment, the surface of the yoke that is opposite from the permanent magnet and adjacent to the separating channel can be dimensionally adapted in its thickness to generate greater magnetic field gradients. According to a further embodiment, the yoke may have, in particular, a trapezoidal or round indentation, into which particularly the separating channel protrudes. According to a further embodiment, a magnetizable element, in particular a plate, can be arranged between the permanent magnet and the separating channel. According to a further embodiment, the surface of the element that is facing the separating channel can be dimensionally adapted in its thickness to generate greater magnetic field gradients. According to a further embodiment, the element may have toward the separating channel a convexly curved or trapezoidal form, in particular corresponding to the form of an opposing indentation of the yoke. According to a further embodiment, the surface of the permanent magnet that is facing the separating channel can be dimensionally adapted to generate greater magnetic field gradients. According to a further embodiment, the permanent magnet may have toward the separating channel a convexly curved or trapezoidal form, in particular corresponding to the form of an opposing indentation of the yoke. According to a further embodiment, an even number of permanent magnets can be provided, an equal number of which lie opposite one another in each case, the yoke taken externally around the permanent magnets connecting the permanent magnets to form magnetic circuits. According to a further embodiment, the yoke that is open to one side may connect the poles remote from the separating channel of two opposing permanent magnets. According to a further embodiment, a pivoting device can be provided for pivoting the yoke that is open to one side and the permanent magnet or the two permanent magnets away from the separating channel. According to a further embodiment, the yoke may consist of iron.

BRIEF DESCRIPTION OF THE DRAWINGS

Further advantages and details emerge from the exemplary embodiments described below as well as on the basis of the drawings, in which.

DETAILED DESCRIPTION

Figure 1:
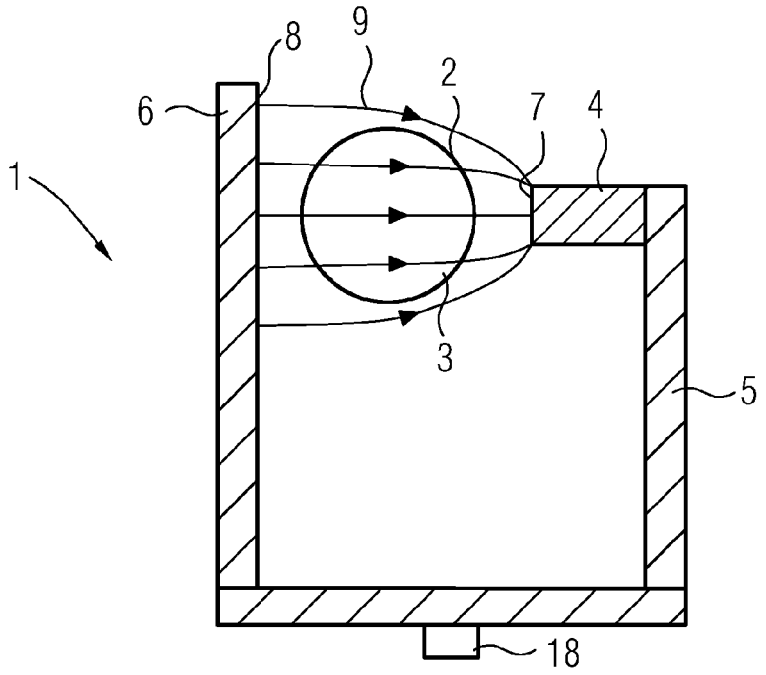
FIG. 1 shows a first exemplary embodiment of a separating device.

According to various embodiments, in the case of a separating device of the type mentioned at the beginning it is provided that a yoke is provided for closing the magnetic circuit from the permanent magnet to the side of the separating channel that is opposite from the permanent magnet and/or between two permanent magnets.

According to various embodiments, accordingly, in addition to simply using one or more permanent magnets, it is envisaged to provide guiding elements in the form of a yoke, in order to minimize stray field losses, and consequently improve the field distribution inside the separating channel. With one or more permanent magnets arranged only to one side of the separating channel, it can therefore be provided that the yoke, and consequently also parts of the field in the form of a magnetic flux through the yoke, are taken to the opposite side of the separating channel, in order in this way ideally to close the magnetic circuit, but in any event to achieve improved gradient formation. Tests have shown that, when using a cylindrical, rod-shaped magnet and a cylindrical iron yoke taken symmetrically to the other side, a fully closed circuit that would deflect particles also to the side opposite from the permanent magnet is not produced, but in any event an improvement of the gradient structure of the magnetic field gradients deflecting the magnetizable particles toward the permanent magnet is achieved, as well as an increase in the field strength. If permanent magnets or permanent magnet combinations arranged on more than one side of the separating channel are connected by a yoke in such a way that the poles remote from the separating channel respectively end in the yoke, a strengthening of the field, and consequently also a strengthening of the magnetic field gradients, can thus be achieved. It should once again be noted at this point that the forces on the magnetizable particles are in a scalar relationship both with the magnetic field gradient and with the magnetic field strength itself, so that, in every case described, the separating effect is improved by the provision according to various embodiments of a yoke.

According to an embodiment, which shows a positive effect specifically when one or more permanent magnets are arranged only to one side of the separating channel, it is provided that the surface of the yoke that is opposite from the permanent magnet and adjacent to the separating channel is larger than the surface of the permanent magnet that is facing the separating channel, in particular the yoke taken on one side around the separating channel is formed on the side opposite from the permanent magnet such that it extends beyond the separating channel. Such a formation of the yoke distributes the exit points of the field lines of the magnetic circuit, it being known that the magnetic field lines always emerge from the surface perpendicularly, so that altogether the field lines emerging from the permanent magnet or the permanent magnet arrangement are drawn widthwise beyond the separating channel, so that stronger gradients are obtained overall. The increase in surface area, in particular the deliberate extension of the yoke leg, consequently serves for generating a divergent field profile with a high gradient, so that the separating properties are further improved.

As an alternative, or particularly also in addition, it may be provided that the surface of the yoke that is opposite from the permanent magnet and adjacent to the separating channel is dimensionally adapted in its thickness to generate greater magnetic field gradients. This exploits the fact, as already described above, that in principle magnetic field lines emerge from the surface of the yoke perpendicularly, so that a field-shaping effect is achieved and, by skilful configuration of the surface, even three-dimensionally in terms of the graphic representation, the field lines are drawn further apart, so that here, too, the divergent field profile is promoted and the magnetic field gradients are increased. It may be provided in practice that the yoke has, in particular, a trapezoidal or round indentation, into which particularly the separating channel protrudes. The yoke may therefore surround certain portions of the separating channel, which leads to a further improved formation of the field, since on the one hand the magnetic field gradients are increased, but on the other hand it is also made possible to bring the corresponding surface of the yoke, which serves primarily for closing the circuit, closer to the magnet.

Further optimization of the field profile can be analogously achieved by the surface that is facing the separating channel on the permanent magnet side and is adjacent to the separating channel being modified. For instance, it may be provided that a magnetizable element, in particular a plate, is arranged between the magnet and the separating channel, it being possible with particular advantage for the surface of the plate that is facing the separating channel to be dimensionally adapted in its thickness to generate greater magnetic field gradients. Here, too, the effect that the magnetic field always emerges from the surface perpendicularly is accordingly exploited, in order ultimately to shape the magnetic field such that, with as strong a magnetic field as possible inside the separating channel, a great magnetic field gradient is also obtained, but at the same time stray losses, that is to say parts of the field outside the separating channel, are reduced. Therefore, it may be provided, for example, that the separating element has toward the separating channel a convexly curved or trapezoidal form, in particular corresponding to the form of an opposing indentation of the yoke. It may therefore be provided that the corresponding dimensional adaptations of the surface of the yoke and of the separating element are adapted to one another, in order in this way to achieve an optimal field profile and an improved separating effect.

As an alternative to a corresponding formation of the surface of a magnetizable element, it may of course also be provided that the surface of the permanent magnet that is facing the separating channel is itself dimensionally adapted to generate greater magnetic field gradients. Also in this case it may be provided that the permanent magnet has toward the separating channel a convexly curved or trapezoidal form, in particular corresponding to the form of an opposing indentation of the yoke.

According to an embodiment, it may also be provided that an even number of permanent magnets are provided, an equal number of which lie opposite one another in each case, the yoke taken externally around the permanent magnets connecting the permanent magnets to form magnetic circuits. With such a configuration it is possible to produce in the interior of the separating channel field structures which deflect the particles very effectively to more than one side, or, in the extreme case of very many permanent magnets, to all sides of the separating channel. The externally surrounding yoke, which connects the poles of the permanent magnet that are remote from the separating channel, thereby acts with a field-strengthening effect and increases the separating performance of the separating device.

In particular when using one or two permanent magnets, the yoke may be designed as open to one side. This makes better access to the separating channel possible also in the area of the magnetic effect. For instance, it may be provided that the yoke that is open to one side connects the poles remote from the separating channel of two opposing permanent magnets.

The use of a yoke that is open to one side may also be advantageously used in some other way. Thus, it may be provided according to an embodiment that a pivoting device is provided for pivoting the yoke that is open to one side and the permanent magnet or the two permanent magnets away from the separating channel. This allows the arrangement generating the deflecting magnetic field to be brought into a position away from the separating channel, so that the latter is not exposed any more to the magnetic effect. This can be used particularly advantageously if, for example, a flushing step is provided for deposits on the walls of the separating channel.

In the case of the configurations with two opposing permanent magnets, two variants are conceivable for their alignment, both of which can be provided according to various embodiments. On the one hand, it may be provided that the poles of the permanent magnets that are directed toward the separating channel are like poles, on the other hand it may be provided that the poles that are situated toward the separating channel are unlike poles.

The yoke may in this case consist, for example, of iron, a magnetic material that is inexpensive and can be easily worked.

FIG. 1 shows a basic diagram of the main components of a separating device 1 according to various embodiments. It comprises a tube 2, which runs perpendicularly to the plane of the image and defines a separating channel 3, which is charged with a suspension comprising magnetizable particles and non-magnetizable particles. The object of the separating device 1 is to allow the magnetizable particles to be separated from the non-magnetizable particles. Provided for this purpose is a permanent magnet 4, which is arranged to one side of the separating channel 3 and with the aid of which it is intended to generate a deflecting magnetic field, which deflects the magnetizable particles to one side of the permanent magnet 4. In this respect, it should be noted at this point that, instead of one permanent magnet 4, it is also possible for a number of permanent magnets to be provided, arranged in series.

Figure 2:
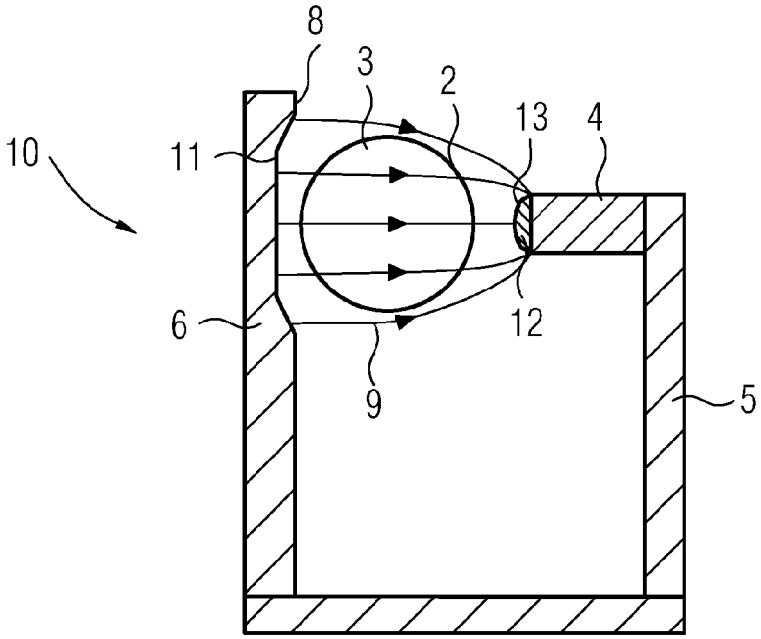
FIG. 2 shows a second exemplary embodiment of a separating device.

To optimize the field properties and to improve the field strength inside the separating channel 3, the separating device 1 according to various embodiments further comprises a yoke 5, which runs from the pole of the permanent magnet 4 that is remote from the separating channel 3 to the side opposite from the permanent magnet 4, where the yoke ends in an extended leg 6. Compared with the surface 7 of the permanent magnet 4 that is facing the separating channel, the leg 6 accordingly has a larger surface 8 facing the separating channel 3. Since the magnetic field lines, indicated here at 9, in principle emerge from the surfaces 7, 8 perpendicularly, their distribution consequently spreads out toward the larger surface 8, so that greater field gradients that deflect the particles toward the permanent magnet 4 are created inside the separating channel 3. At the same time, a greater field strength can be found overall in the separating channel 3 as a result of the closing of the magnetic circuit by the yoke 5, which incidentally consists of iron. FIG. 2 shows a further embodiment of a separating device 10. Parts that are the same are provided here with the same reference numerals. As can be seen, the second exemplary embodiment, the separating device 10, differs from the separating device 1 on the one hand in that the surface 8 of the joke 5 that is facing the separating channel 3 is dimensionally adapted, specifically in such a way as to provide a trapezoidal indentation 11, into which the separating channel 3 or the tube 2 protrudes a little. Moreover, a plate 12, which is likewise produced from iron, is provided between the permanent magnet 4 and the separating channel 3, while the surface 13 facing the separating channel 3 has a form that is slightly convexly curved in a trapezoidal manner. In this case, the convex curvature of the surface 13 corresponds substantially to the indentation 11.

It should be noted at this point that the surface 7 of the permanent magnet 4 that is facing the separating channel 3 can also be dimensionally adapted directly to improve the deflecting properties. Moreover, other dimensional adaptation possibilities are also conceivable in principle.

The corresponding dimensional configuration of the surfaces 8 and 13 makes it possible, as indicated by the field lines 9, to adapt the deflecting magnetic field with respect to the field strength and the deflecting magnetic field gradients in such a way that better separation is made possible. In particular, the trapezoidal indentation 11 makes a stronger magnetic field gradient possible over the entire width of the separating channel 3, so that magnetizable particles remote from the permanent magnet can also be deflected to the side of the permanent magnet 4.

Figure 3:
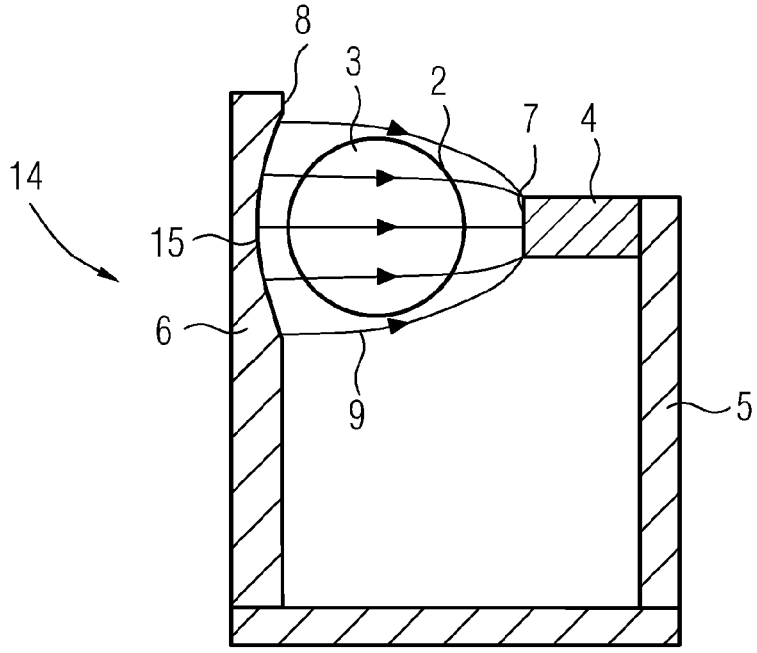
FIG. 3 shows a third exemplary embodiment of a separating device.

A third exemplary embodiment of a separating device 14 is shown by FIG. 3. As a difference from FIG. 2, here a round indentation 15 is provided, allowing better adaptation to the tube 2 or the separating channel 3. Here, too, the resultant field lines 9 are indicated. As can be seen, it is also possible in this way to achieve a higher field strength and a better distribution of the deflecting force.

Figure 4:
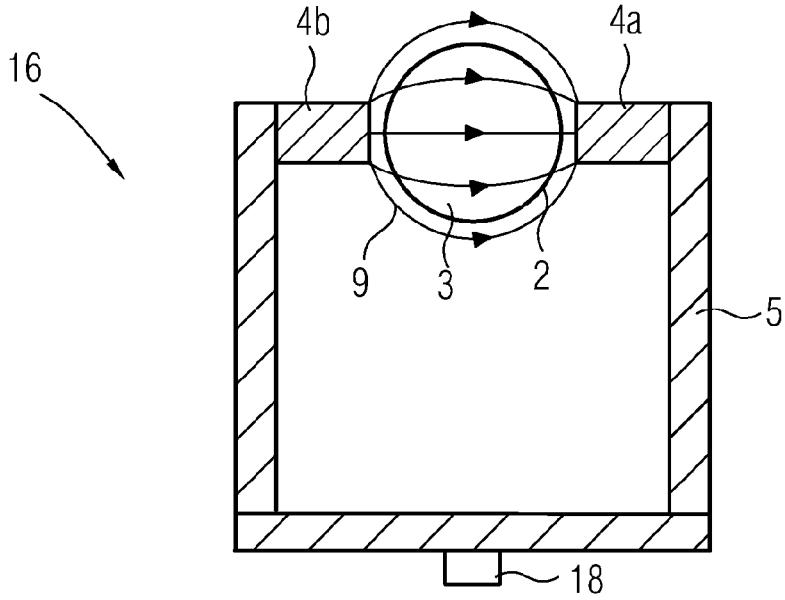
FIG. 4 shows a fourth exemplary embodiment of a separating device.

A fourth exemplary embodiment of a separating device 16 is schematically represented in FIG. 4. In this case, two permanent magnets 4*a* and 4*b* are provided, adjacent to the separating channel 3 on two opposite sides. The poles of the permanent magnets 4*a* and 4*b* that are remote from the tube 2 are connected by the yoke 5 of iron, which makes an increase in the field strength inside the separating channel 3 possible by closing the magnetic circuit. The field lines are once again indicated at 9.

As can be seen, the yoke 5 connecting the two permanent magnets 4*a* and 4*b* is open to one side. This makes it possible to pivot the yoke 5 with the permanent magnets 4*a*, 4*b* along a horizontal axis running in the plane of the image, so that the yoke 5 and the permanent magnets 4*a* and 4*b* can be removed from the separating channel 3. It is therefore advantageously possible, for example for the removal of deposits on the side walls of the tube 2 in a flushing step, to provide a pivoting device 18, which makes this operation of pivoting the yoke 5 away from the separating channel 3 possible. It should be mentioned that, even when using only a single permanent magnet 4, the yoke 5 may be open to one side, as is the case for example in FIG. 1. There, too, a pivoting device 18 may accordingly be advantageously used. It is accordingly also indicated in FIG. 1.

Figure 5:
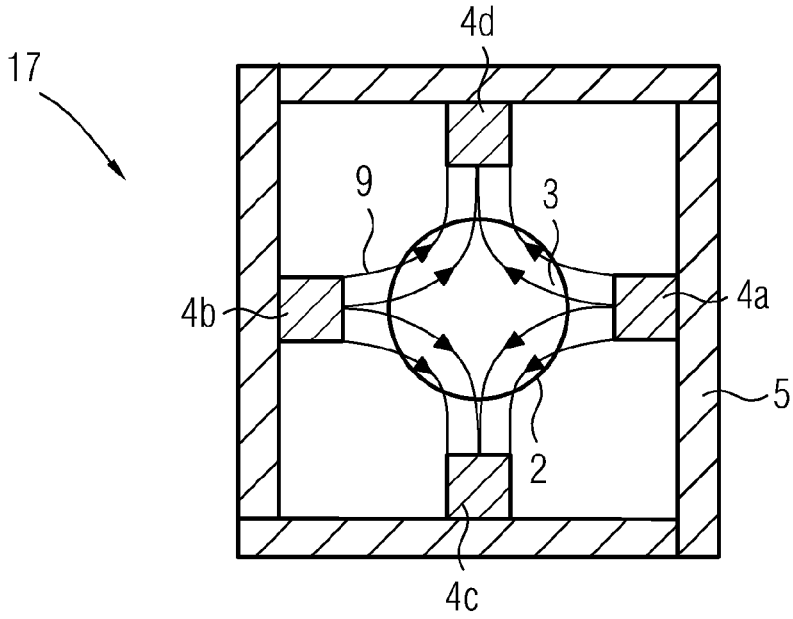
FIG. 5 shows a fifth exemplary embodiment of a separating device.

A fifth exemplary embodiment of a separating device 17, having four permanent magnets 4*a*, 4*b*, 4*c* and 4*d*, with two of the permanent magnets respectively lying opposite one another, specifically 4*a* opposite 4*b* and 4*c* opposite 4*d*, is represented in FIG. 5. The yoke 5 connecting the poles of the permanent magnets 4*a*-4*d* that are remote from the separating channel 3 is configured in a surrounding manner and respectively closes four magnetic circuits, as also depicted by the field lines 9. Arrangements with more than four permanent magnets are also conceivable, a very large number of permanent magnets ultimately producing a force distribution that deflects all of the magnetizable particles toward the wall of the separating channel 3.

What is claimed is:

1. A separating device for separating magnetizable particles and non-magnetizable particles transported in a suspension flowing through a separating channel, the separating device comprising:

a yoke arranged at least partially around the separating channel, the yoke including:

a first yoke portion adjacent to a first side of the separating channel;

a second yoke portion adjacent to a second side of the separating channel opposite the first side;

wherein the first yoke portion, but not the second yoke portion opposite the first yoke portion, supports at least one permanent magnet;

wherein the at least one permanent magnet is configured to cooperate with the second yoke portion to define a magnetic field passing through the separating channel;

wherein the at least one permanent magnet comprises at least one surface facing the second yoke portion;

wherein the second yoke portion comprises at least one surface facing the first yoke portion; and wherein the at least one surface of the second yoke portion is larger than the at least one surface of the at least one permanent magnet, such that the magnetic field passing though the separating channel is asymmetric about a plane perpendicular to a direction extending from the at least one permanent magnet to the second yoke portion.

2. The separating device according to claim 1, wherein the at least one surface of the second yoke portion that is opposite from the at least one permanent magnet and adjacent to the separating channel has a thickness suitable to increase magnetic field gradients.

3. The separating device according to claim 2, wherein the second yoke portion has a trapezoidal or round indentation, into which the separating channel protrudes.

4. The separating device according to claim 1, wherein a magnetizable element is arranged between the at least one permanent magnet and the separating channel.

5. The separating device according to claim 4, wherein a surface of the magnetizable element that is facing the separating channel has a thickness suitable to increase magnetic field gradients.

6. The separating device according to claim 5, wherein the magnetizable element has toward the separating channel a convexly curved or trapezoidal form.

7. The separating device according to claim 1, wherein an area of the at least one surface of the at least one permanent magnet is suitable to increase magnetic field gradients.

8. The separating device according to claim 7, wherein the permanent magnet has toward the separating channel a convexly curved or trapezoidal form.

9. The separating device according to claim 1, wherein an even number of permanent magnets are provided, an equal number of which lie opposite one another in each case, the yoke taken externally around the permanent magnets connecting the permanent magnets to form magnetic circuits.

10. The separating device according to claim 1, wherein the yoke that is open to one side connects the poles remote from the separating channel of two opposing permanent magnets.

11. The separating device according to claim 1, wherein a pivoting device is provided for pivoting the yoke that is open to one side and the permanent magnet or the two permanent magnets away from the separating channel.

12. The separating device according to claim 1, wherein the yoke consists of iron.

13. The separating device according to claim 1, wherein the yoke extends from the first yoke portion, around the separating channel, and to the second yoke portion opposite the first side, and wherein the first yoke portion extends beyond the separating channel in a direction perpendicular to the direction extending from the at least one permanent magnet to the second yoke portion.

14. The separating device according to claim 4, wherein the magnetizable element is a plate.

15. The separating device according to claim 5, wherein the magnetizable element has toward the separating channel a convexly curved or trapezoidal form corresponding to the form of an opposing indentation in the second yoke portion.

16. The separating device according to claim 7, wherein the at least one permanent magnet has toward the separating channel a convexly curved or trapezoidal form corresponding to the form of an opposing indentation in the yoke.

17. A method for separating magnetizable particles and non-magnetizable particles transported in a suspension flowing through a separating channel, comprising:

providing a separating device comprising:

a yoke arranged at least partially around the separating channel, the yoke including:

a first yoke portion adjacent to a first side of the separating channel;

a second yoke portion adjacent to a second side of the separating channel opposite the first side;

wherein the first yoke portion, but not the second yoke portion opposite the first yoke portion, supports at least one permanent magnet;

wherein the at least one permanent magnet is configured to cooperate with the second yoke portion to define a magnetic field passing through the separating channel;

wherein the at least one permanent magnet comprises at least one surface facing the second yoke portion;

wherein the second yoke portion comprises at least one surface facing the first yoke portion;

wherein the at least one surface of the second yoke portion is larger than the at least one surface of the at least one permanent magnet, such that the magnetic field passing though the separating channel is asymmetric about a plane perpendicular to a direction extending from the at least one permanent magnet to the second yoke portion; and flowing the suspension including magnetizable particles and non-magnetizable particles through the separating channel, such that the asymmetric magnetic field separates at least a portion of the magnetizable particles from the non-magnetizable particles.

18. The method according to claim 17, wherein the at least one surface of the second yoke portion that is opposite from the at least one permanent magnet and adjacent to the separating channel has a thickness suitable to increase magnetic field gradients.

* * * * *